United States Patent [19]

Smith

[11] B 3,982,221

[45] Sept. 21, 1976

[54] CONTACT SPRING FOR VARIABLE RESISTANCE DEVICE

[75] Inventor: Ronald Eugene Smith, Riverside, Calif.

[73] Assignee: Bourns, Inc., Riverside, Calif.

[22] Filed: Dec. 2, 1974

[21] Appl. No.: 528,761

[44] Published under the second Trial Voluntary Protest Program on February 10, 1976 as document No. B 528,761.

[52] U.S. Cl. ..... 338/202; 338/118; 338/128; 338/160; 338/176

[51] Int. Cl.[2] ..... H01C 1/12

[58] Field of Search ..... 338/118, 128, 133, 160, 338/165, 167, 171, 176, 202

[56] References Cited

UNITED STATES PATENTS

| | | | |
|---|---|---|---|
| 3,201,737 | 8/1965 | Mathison | 338/202 |
| 3,371,305 | 2/1968 | Delong et al. | 338/202 |

*Primary Examiner*—C. L. Albritton
*Attorney, Agent, or Firm*—Richard S. Koppel; William G. Becker

[57] ABSTRACT

A contact spring, suitable for use in a variable resistance device having a resistance strip and at least one collector strip adjacent the resistance strip. The contact spring is formed in a unitary construction from a single piece of sheet metal and includes electrically conductive cantilever spring members which depend from a base member and are adapted for sliding electrical contact with the resistance and collector strips. Stiffly flexible, resilient means, preferably in the form of additional cantilever spring members disposed in cruciform relation to the contact spring members, depend from the base member to back up each of the contact spring members by engaging an intermediate portion thereof to retard flexing of the contact spring members toward the base member. The resulting contact spring is quite simple in construction, yet produces a substantially greater contact force with the resistance and collector strips than is achieved by simple cantilever contact spring arms. The effective spring life is accordingly increased because of reduced deterioration during sliding contact with the elements of the resistance device.

15 Claims, 5 Drawing Figures

CONTACT SPRING FOR VARIABLE RESISTANCE DEVICE

BACKGROUND OF THE INVENTION

This invention relates to electrical contact devices, and more particularly to a contact spring adapted for sliding electrical contact with the resistance and collector strips of a variable resistance device.

The contact strip embodied by the present invention is intended for use in a variable resistance device of the type having a flat resistance strip connected at one end to a terminal, and a collector strip running parallel to one or both sides of the resistance strip and connected to a second terminal. The contact spring effects a local short circuit between the resistance and collector strips, the total resistance between the two terminals being determined primarily by the location of the spring. Means are provided to move the spring across the surfaces of the strips, thereby enabling the resistance between the two terminals to be varied from a very low value to one that reflects substantially the full value of the resistance strip.

It has been found that the longevity of the spring depends to a considerable extent upon the contact force between the spring and the resistance and collector strips. Should the contact not be firm enough, the passage of large amounts of current between the spring and strips can produce sufficient heating to cause surface deterioration, thereby restricting the amount of effective surface area available for current transfer and further aggravating the heating problem. Continued operation at high currents can lead to unacceptable variances in the output resistance and eventual complete failure of the device. While numerous ways are available to increase the spring contact force, such as the use of leaf spring arrangements, the space available for the spring may be so small as to place severe restrictions on the permissible size of the contact spring and preclude the use of more elaborate devices.

One type of spring that has been found to successfully overcome the space limitation problem consists of a simple base member with a cantilever spring arm depending downward at an acute angle to the base member to contact the resistance strip, and additional cantilever spring arms for contacting the collector strips depending from the base member in crisscross relation to the first mentioned spring arm and on either side thereof. While this arrangement effectively utilizes the small space available, the spring forces developed may not be sufficient to prevent deterioration at the points of contact between the spring arms and the resistance and contact strips when large currents are carried by the resistance device.

SUMMARY

In view of the above stated problems associated with the prior art, it is an object of the present invention to provide a novel and improved contact spring, suitable for use in a variable resistance device, that is capable of developing sufficient contact force with the resistance and collector strips of the device to overcome contact point contamination caused by high operating temperatures.

Another object is the provision of a novel and improved contact spring that is small in size and can be used in variable resistance devices having only a small space to accommodate the contact spring.

A further object is the provision of a novel and improved contact spring having the low spring rate and independent contact member action associated with relatively thin material, and that yet provides the greater spring force of a thicker material.

Yet another object of the invention is the provision of a novel and improved contact spring that is simple in construction and inexpensive to manufacture.

In the accomplishment of these and other objects, the present invention provides a contact spring that is suitable for use in a variable resistance device of the type which includes substantially parallel and mutually spaced resistance and collector strips. Means are provided to move the contact spring across the surfaces of the resistance and collector strips, thereby enabling the resistance between electrical terminals associated with each of the strips to be varied. The contact spring comprises a base member having electrically conductive cantilevered spring contact means depending therefrom for sliding electrical contact with the resistance and collector strips, so as to effect a local short circuit between the strips at the spring location. Also depending from the base member is a stiffly flexible, resilient back-up means which extends toward the contact means and is disposed in the flexing path thereof to retard flexing thereof toward the base member. A substantially greater contact force is thereby established between the contact means and the resistance and collector strips when the contact means is flexed back into the back-up means than could otherwise be achieved by the spring force of the contact means alone.

In a preferred embodiment of the invention, the contact means comprises first and second cantilevered contact arms which depend from the base member to respectively contact the resistance and collector strips, with additional contact arms provided for additional collector strips as required. Separate back-up members are provided for each of the contact arms, each of the said members comprising a stiffly flexible, resilient cantilevered spring member depending from the base member in cruciform relation to its respective contact arm, so as to engage an intermediate portion of the contact arm when the said arm is flexed back toward the base member. The back-up members are spaced from the unflexed position of the contact arms so as to impart an increasing amount of spring force to the contact arms as they approach the base member.

The contact spring is preferably formed in a one-piece construction from a single piece of sheet metal by bending various members projecting from the sheet member so as to form the contact arms and the back-up members. In such a construction, the contact arm for the resistance strip is conveniently coplanar with the back-up members for the collector strips, while the contact arms for the collector strips are coplanar with the back-up member for the resistance strip.

Further advantages and features of the invention will be apparent to those skilled in the art from the ensuing detailed description thereof, taken together with the accompanying drawings, in which.

DETAILED DESCRIPTION

Figure 1:
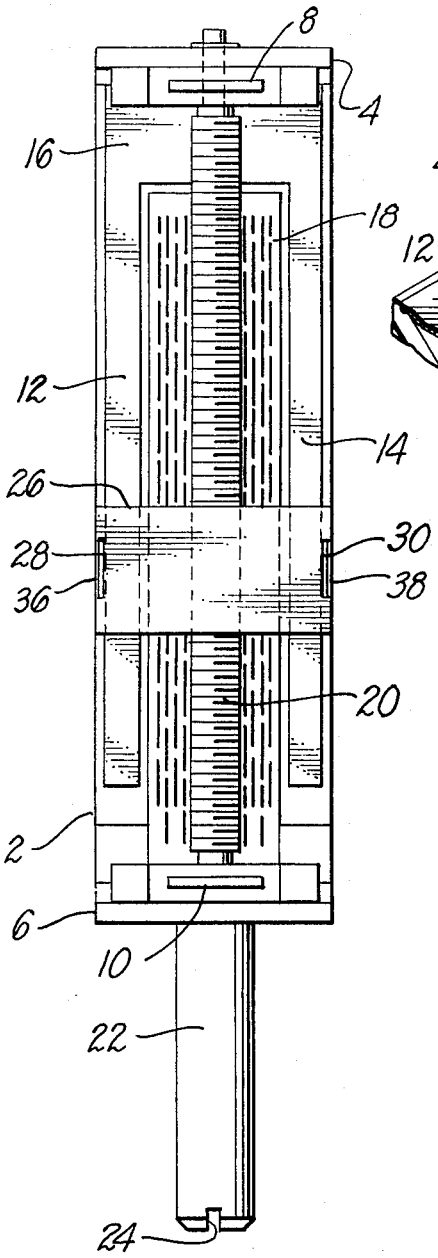
FIG. 1 is a plan view of a variable resistance device in which the contact spring of the present invention may be used.

A typical variable resistance device for which the contact spring of the present invention is intended is shown in FIG. 1. The device is formed on an electrically insulative substrate 2 having raised portions 4 and 6 at either end from which electrical termination tabs 8 and 10 extend. A pair of electrically conductive, flat collector strips 12 and 14 extend along parallel edges for most of the distance of substrate 2, merging at one end into a plate 16 which is electrically connected to terminal 8. A flat resistance strip 18, carried along the central portion of substrate 2 between and slightly spaced from collector strips 12 and 14, is electrically connected with terminal 10.

An adjustable lead screw 20 is held over resistance strip 18 by a mechanical connection with raised substrate portions 4 and 6, one end 22 of the lead screw extending outward from the resistance device with a slotted head 24 to facilitate adjustment of the screw by a screwdriver. A spring mounting body 26, formed from an electrically insulative material and carried on lead screw 20 by means of a threaded interior opening, is movable back and forth across the length of resistance strip 18 by rotation of lead screw 20. Vertical slots 28 and 30 are provided along the sides of mounting body 26 to hold the subject contact spring.

The variable resistance device described above is typical of a type for which the contact spring of the present invention is intended. In such a device, a contact spring is normally carried by mount 26 so as to effect a local short circuit between the collector and resistance strips at the spring location. A resistance circuit is thereby formed comprising terminal 8, collector plate 16, the portions of collector strips 12 and 14 between plate 16 and the spring, the contact spring itself, the portion of resistance strip 18 between the contact spring and raised portion 6 of the resistance device, and terminal 10. Except for the aforesaid portion of resistance strip 18, all the elements in the resistance circuit have a small or negligible resistance value. The total resistance between terminals 8 and 10 is thereby determined substantially by the portion of resistance strip 18 included in the resistance circuit. The contact spring is moved along the surface of the resistance and collector strips by rotating lead screw 20, permitting the resistance between terminals 8 and 10 to be varied from a minimal amount when the contact spring is adjacent to raised portion 6, to a maximum resistance when the contact spring is at the end of resistance strip 18 near raised portion 4.

Figure 2:
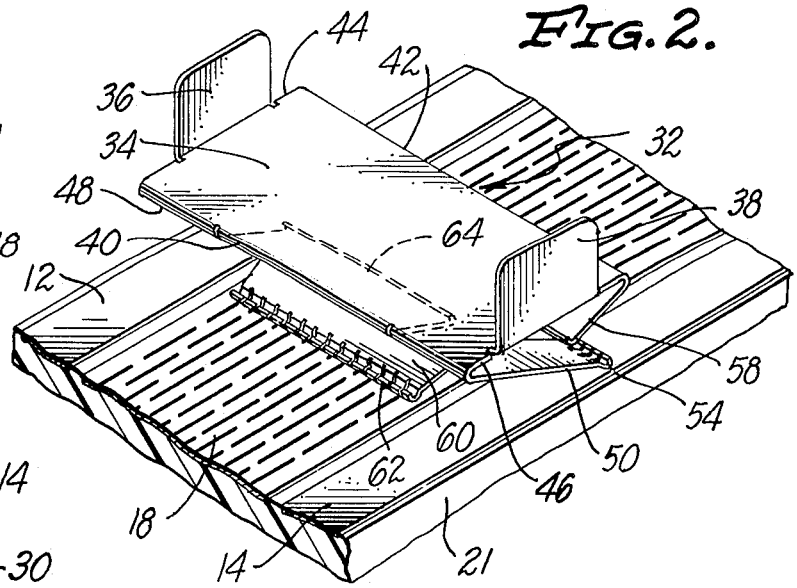
FIG. 2 is an enlarged, somewhat exploded view showing the contact spring in operative position above but not flexed against the variable resistance device shown in FIG. 1.
Figure 3:
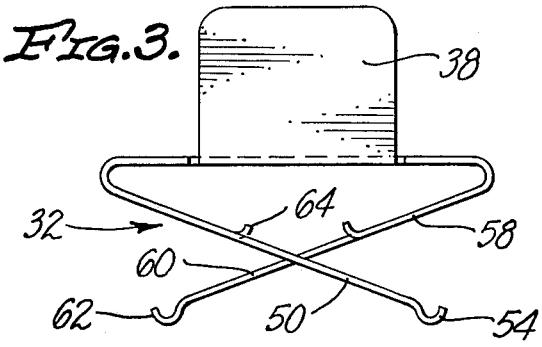
FIG. 3 is an elevation view of the contact spring.
Figure 5:
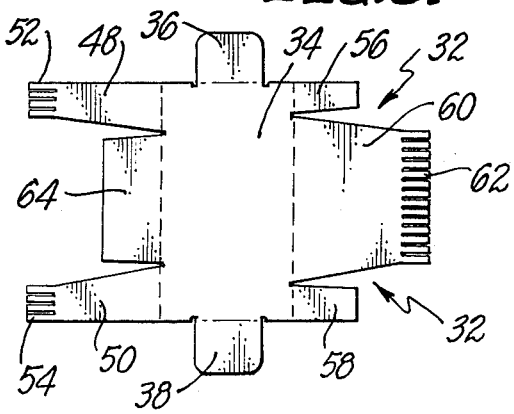
FIG. 5 shows a sheet metal member arranged for bending so as to form the contact spring of the present invention.

Contact spring 32, which is preferably formed from a single piece of electrically conductive sheet metal, is shown in an unflexed position in FIGS. 2 and 3 and flattened out in FIG. 5. A beryllium copper compound designated No. 172 by the Copper Development Association, together with an inner nickel coating and outer gold coating having a combined thickness of about 0.0002 inch, has been found to be a highly desirable material in terms of durability and maintenance of a good contact force. The total thickness of the spring illustrated in the drawings is about 0.008 inch.

Contact spring 32 includes a generally flat base member 34 having a pair of upturned mounting tabs 36 and 38 at either end which respectively fit into slots 28 and 30 to clip spring 32 against the underside of mounting body 26. Base member 34 is generally rectangular in shape, with two opposed sides 40 and 42 disposed at right angles to the axis of spring travel, and the other two sides 44 and 46 (supporting mounting tabs 36 and 38 respectively) disposed parallel to the axis of travel.

Contact arms 48 and 50 depend from each end of side 40 at an acute angle to base member 34, forming a cantilever spring construction in which arms 48 and 50 can be resiliently flexed from their original positions by flexing about their juncture with side 40. In the embodiment shown, the arms make an angle of 21° with base member 34, the radius of curvature at the bends being about 0.01 inch. Contact arms 48 and 50 are provided at their ends with a plurality of generally "U" shaped fingers 52 and 54 which establish the actual physical contact with collector strips 12 and 14 when the resistance device is assembled.

It can be seen that as contact spring 32 is pressed down against the variable resistance device, contact arms 48 and 50 are flexed upward toward base 34. In order to increase the resistance to such upward flexing and thereby enhance the force of contact established between arms 48 and 50 and collector strips 12 and 14, back-up members 56 and 58, each comprising a tab-like extension of base member 34 bent under the base member at opposite ends of side 42, are provided respectively for contact arms 48 and 50. Back-up members 56 and 58 are foreshortened with respect to their associated contact arms, the back-up members in one typical configuration being approximately 0.165 inch long and the contact arms approximately .360 inch long. Contact arms 48 and 50 lie in the same plane, as do back-up members 56 and 58, the contact arms and back-up members being disposed in mutual cruciform relation, i.e., forming a cross-like configuration between the contact arms and the plane of the back-up members. In a typical unflexed position, the contact arm plane crosses the back-up member plane at an angle of about 42°.

In a similar fashion to the collector strip contact arms and back-up members, a relatively wide contact arm 60 for resistance strip 18 depends from side 42 of base member 34 between and substantially coplanar with collector back-up members 56 and 58, a row of generally "U" shaped fingers 62 being provided at the end of arm 60 to establish wiping contact with resistance strip 18. A back-up member 64 depends in cruciform relation to arm 60 from side 40 of base member 34, between and substantially coplanar with collector contact arms 48 and 50. The cantilever spring action described above with respect to the collector strip contact arms and back-up members is also exhibited by contact arm 60 and back-up member 64, resulting in a firm electrical connection between contact spring 32 and resistance strip 18.

Figure 4:
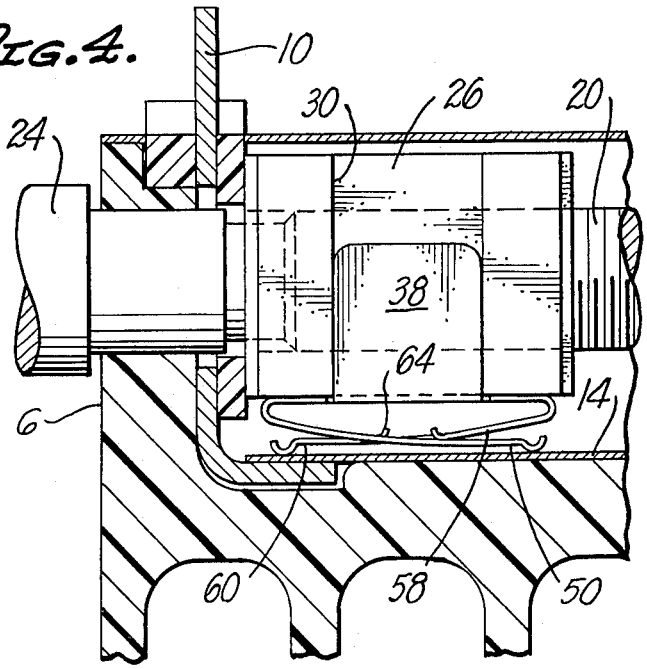
FIG. 4 is a fragmentary side elevation view of the contact spring positioned on the variable resistance device.

As best seen in FIGS. 2 and 3, which depict the contact spring in an unflexed position, back-up members 56, 58, and 64 are too short to reach their respective contact arms 48, 50, and 60, resulting in a space or gap therebetween. When in place on spring mount 26 (see FIG. 4), however, the clearance between contact spring 32 and the resistance and collector strips is sufficiently constricted such that contact arms 48, 50, and 60 are flexed upward toward base member 34, intermediate portions thereof engaging and pushing into back-up members 56, 58, and 64. The back-up members are accordingly also flexed upward, thereby compounding the spring force urging the contact arms against their respective collector and resistance strips. Since the flexing moment-arm of the back-up members is less than that of the contact arms, their contribution to the total contact force is proportionally greater than that of the contact arms for equal amounts of flexing. The net effect is to significantly increase the contact force, thereby greatly reducing problems of deterioration associated with operation at high current/temperature levels.

FIG. 5 shows a convenient pattern that may be utilized for stamping the contact spring out of sheet metal. The contact arms, back-up members and mounting tabs each project outward from the base member 34, the bending axes for each of these elements in forming the final construction being indicated by dashed lines. The resulting contact spring is quite simple in structure, yet provides a significantly greater contact force than can be achieved by a simple cantilever spring arrangement.

While a particular embodiment of the invention has been shown and described, numerous additional modifications and variations are possible in light of the above teachings. For example, while it might add unduly to the complexity of the apparatus, a back-up means such as a resilient pad could be used to underlie and reinforce the contact arms, or the arrangement of the various elements depending from base member 34 could be altered. It is therefore intended that the scope of the invention be limited only in and by the terms of the appended claims.

What is claimed is:

1. A contact spring, suitable for use in a variable resistance device having a resistance strip, a collector strip adjacent said resistance strip, electrical terminals associated with said resistance and collector strips, and means to move a contact spring across the surfaces of said resistance and collector strips, said contact spring comprising:

a base member adapted for attachment to said spring moving means, electrically conductive contact means depending from said base member, said contact means comprising a cantilever spring means adapted for sliding electrical contact with said resistance and collector strips so as to effect a short circuit therebetween, and a stiffly flexible, resilient back-up means depending from said base member toward said contact means, said back-up means being disposed in the flexing path of said contact means to retard flexing thereof toward said base member, whereby a substantially greater contact force is established between said contact means and said resistance and collector strips when said contact means flexes into said back-up means than would be established by the spring force of said contact means alone.

2. The contact spring of claim 1, wherein said back-up means comprises a second cantilever spring means.

3. The contact spring of claim 2, wherein said back-up means depends from said base member in cruciform relation to said contact means.

4. The contact spring of claim 1, wherein said contact means comprises first and second spring contact arms depending from said base member to contact said resistance strip and collector strip respectively, and said back-up means comprises first and second stiffly flexible, resilient members respectively disposed in the flexing path of said first and second contact arms.

5. The contact spring of claim 4, wherein each of said back-up members comprises a cantilever spring member depending from said base member so as to engage an intermediate portion of its respective contact arm when said arm is flexed toward said base member.

6. The contact spring of claim 5, wherein said back-up members are spaced from the unflexed position of said contact arms.

7. The contact spring of claim 5, wherein each of said back-up members depends from said base member in cruciform relation to its respective contact arm.

8. The contact spring of claim 7, wherein said first and second contact arms depend from said base member in laterally spaced cruciform relation.

9. The contact spring of claim 8, wherein the first contact arm is substantially coplanar with the second back-up member, and the second contact arm is substantially coplanar with the first back-up member.

10. The contact spring of claim 8, formed in a one-piece construction from a single piece of sheet metal.

11. The contact spring of claim 4, adapted for use with a variable resistance device having a pair of collector strips disposed on opposite sides of a resistance strip, said second contact arm being adapted to contact one of said collector strips, and further including a third cantilever spring contact arm depending from said base member and adapted to contact the other of said collector strips, and a third stiffly flexible, resilient back-up member disposed in the flexing path of said third contact arm.

12. A compound contact spring, for use with a variable resistance device having a resistance strip, a collector strip adjacent said resistance strip, electric terminals associated with said resistance and collector strips, and means to move a contact spring across the surfaces of said resistance and collector strips, said compound contact spring comprising:

a single piece of sheet metal having a base portion and first, second, third, and fourth members projecting outwardly from said base portion, said first and second members being bent at acute angles to a face of said base portion to form cantilever spring contact arms adapted to wipe against said resistance and collector strips respectively, and said third and fourth members being bent at acute angles to said base portion face to respectively underlie said first and second members and thereby provide a back-up cantilever spring means opposing flexing of said first and second members toward said base portion.

13. The compound contact spring of claim 12, wherein each of said contact arms is aligned with its respective back-up member on the opposite side therefrom of said base portion, each of said contact arms and their respective back-up members being bent toward each other in mutual cruciform relation.

14. The compound contact spring of claim 13, wherein each of said back-up members is foreshortened with respect to its respective contact arm and aligned with the flexing path thereof, each of said contact arms having an unflexed position at which it is spaced from its respective back-up member.

15. The compound contact spring of claim 12, suitable for use with a variable resistance device having a pair of collector strips disposed on opposite sides of a resistance strip, said second contact arm being adapted to contact one of said collector strips, wherein said sheet metal piece further includes a fifth projecting member bent at an acute angle to said base portion face to form a cantilever spring contact arm for the other of said collector strips, and a sixth projecting member bent at an acute angle to said base portion face to underlie said fifth member and thereby provide a back-up cantilever spring means opposing flexing of said fifth member toward said base portion.

* * * * *